US006561879B2

(12) United States Patent
Voigt

(10) Patent No.: US 6,561,879 B2
(45) Date of Patent: May 13, 2003

(54) CONDITIONING DEVICE FOR GRINDING WHEELS

(75) Inventor: Klaus Voigt, Remscheid (DE)

(73) Assignee: Wendt GmbH, Meerbusch (DE)

( * ) Notice: Subject to any disclaimer, the term of this patent is extended or adjusted under 35 U.S.C. 154(b) by 0 days.

(21) Appl. No.: 09/981,049

(22) Filed: Oct. 16, 2001

(65) Prior Publication Data

US 2002/0078940 A1 Jun. 27, 2002

(30) Foreign Application Priority Data

Oct. 23, 2000 (EP) ..... 00122993

(51) Int. Cl.[7] ..... B24B 1/00
(52) U.S. Cl. ..... 451/56; 125/11.04
(58) Field of Search ..... 451/56, 11, 442; 125/11.04, 11.11

(56) References Cited

U.S. PATENT DOCUMENTS

| | | | | | |
|---|---|---|---|---|---|
| 2,827,037 | A | * | 3/1958 | Wallace et al. | 125/11.03 |
| 3,791,367 | A | * | 2/1974 | Cirell et al. | 125/11.01 |
| 4,180,046 | A | * | 12/1979 | Kerner | 125/11.11 |
| 4,255,905 | A | * | 3/1981 | Kerner | 451/56 |
| 4,274,231 | A | * | 6/1981 | Verega | 125/11.03 |
| 5,065,733 | A | * | 11/1991 | Swenson | 125/11.21 |
| 5,117,588 | A | * | 6/1992 | Osborn et al. | 125/11.06 |
| 5,738,569 | A | * | 4/1998 | Mackowsky | 451/324 |
| 6,012,972 | A | * | 1/2000 | Jankowski | 451/47 |
| 6,361,412 | B1 | * | 3/2002 | Kaiser | 125/11.03 |

FOREIGN PATENT DOCUMENTS

| | | | | |
|---|---|---|---|---|
| DE | 3238691 | A | * 4/1984 | B24B/47/18 |
| GB | 2020585 | A | * 11/1979 | B24B/53/12 |
| GB | 2203366 | A | * 10/1988 | B24B/53/07 |
| JP | 61004668 | A | * 1/1986 | B24B/53/14 |
| JP | 07009341 | A | * 1/1995 | B24B/53/12 |
| JP | 2000108028 | A | * 4/2000 | B24B/49/18 |

* cited by examiner

*Primary Examiner*—Joseph J. Hail, III
*Assistant Examiner*—David B. Thomas
(74) *Attorney, Agent, or Firm*—Kohn & Associates, PLLC

(57) ABSTRACT

The invention relates to a conditioning device (1) for grinding wheels (2) for machining the edge areas of plate-shaped objects, such as, for example, glass panes or the like, for which the grinding wheels (2), in a conditioned state, have at least one circumferential groove (3) each, which, at least in a partial section, tapers off towards the grinding wheel center. To provide such a conditioning device with which the conditioning of such grinding wheels is possible in an easy way and at any time and any place, the conditioning device has to have a cross section adapted to the cross section of the groove to be achieved, wherein the width of the conditioning device basically corresponds to the width of the groove(s) and the length orientation from one lateral end to the other lateral end of the conditioning device is configured in accordance with the depth orientation from one side edge to the other side edge of the groove(s) with growing length at increasing depth to be achieved.

13 Claims, 3 Drawing Sheets

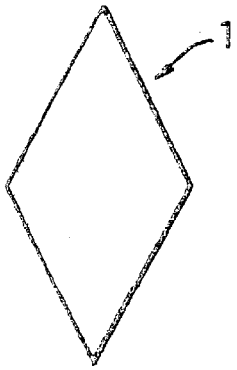
FIG. 2
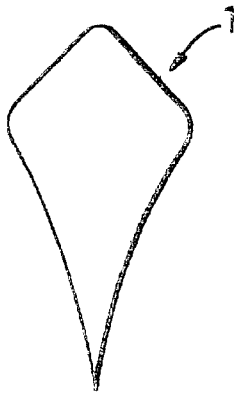
FIG. 3
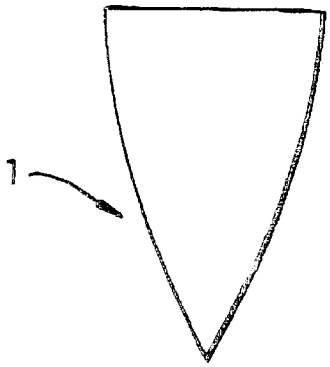
FIG. 4
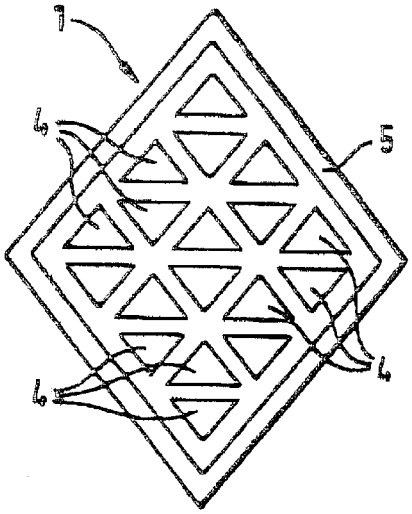
FIG. 5
FIG. 6
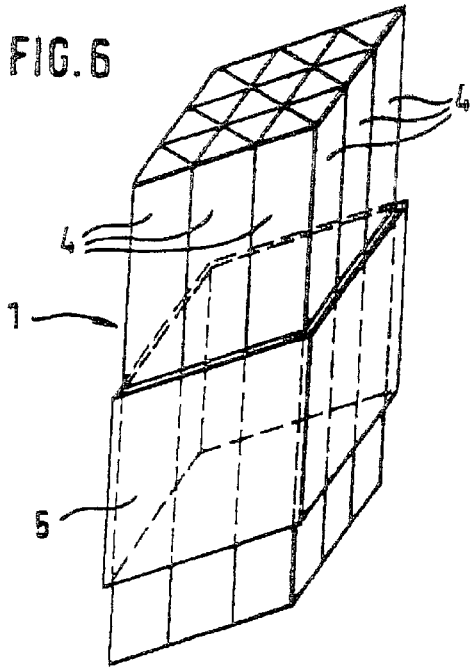

CONDITIONING DEVICE FOR GRINDING WHEELS

CROSS REFERENCE TO RELATED APPLICATIONS

This application claims priority to European Application No. 00122993.9, filed Oct. 23, 2000, which is incorporated herein by reference.

BACKGROUND OF THE INVENTION

1. Technical Field

The invention relates to a conditioning device for grinding wheels for machining the edge areas of plate-shaped objects, such as, for example, glass panes or the like, for which the grinding wheels, in a conditioned state, have at least one circumferential groove each which, at least in a partial section, tapers off towards the grinding wheel center.

2. Background Art

Bar-shaped conditioning devices are known in general practice and principally consist of a mineral material or materials having mineral components, the abrasive effect of which sets back the bond of the grinding wheel to be conditioned. The usual components of the material are, among others, aluminium oxide (corundum) and silicon carbide. The cross section is rectangular and the material properties are homogenous in the entire conditioning device.

The conditioned grinding wheel has a circumferential groove tapering off towards the grinding wheel center and of which the cross section has, in particular, a more or less semicircular form.

During the grinding operation of the edge areas of plate-shaped objects, such as, for example, the rounding of the edges of glass panes used in automobiles, the edge to be machined is at least brought to a convex curved form while, at the same time, the grinding wheel itself is subjected to a "machining" process due to wear caused by the machining of the edge areas of the glass panes so that the groove contour gradually resembles the contour of the unmachined edge areas of the glass panes and therefore needs to be conditioned.

By conditioning is basically understood to mean influencing of the sharpness of the grinding wheel surface including the groove surface, to maintain the groove contour for the longest possible time. In addition, by conditioning is also understood to indicate generation or restoring of a groove form, which has been used up or worn down or which has almost disappeared completely by numerous grinding operations.

As a result of the grinding operation of the edge areas, the corresponding grinding wheel surface cannot only become dull, but it can also be "over-sharpened", which is equally undesired. Both deviations from the normal, sharpened desired state can be eliminated by conditioning.

Conditioning by means of the aforementioned bar-shaped conditioning devices is achieved in that the conditioning device is provided with a profile adapted to the cross section of the groove to be achieved and brought into contact with the rotating grinding wheel with the result that the distribution of the sharpening effect over the entire groove form is uniform so that partial areas are either sharpened insufficiently or other partial areas are over-sharpened As the contour of the conditioning device rapidly adapts to the contour of the groove so that the conditioning device has no more influence on the groove, it is general practice that the conditioning, especially the profiling, is usually carried out by cavity sinking with an electrode being profiled according to the groove form.

The disadvantage of this is that this method requires a complex and expensive eroding equipment so that the worn grinding wheels are usually sent away to the manufacturer or to another specialist for reconditioning. This in turn is a time consuming and expensive solution because it requires at least one spare grinding wheel to be available until the return of the conditioned grinding wheel. If several grinding machines and/or several differently profiled grinding wheels are concerned, this can involve quite an expensive stock-keeping.

SUMMARY OF THE INVENTION

The task of the invention is to avoid the aforementioned disadvantages and to provide a conditioning device for grinding wheels for machining the edge areas of plate-shaped objects, such as, for example, glass panes or the like, for which the grinding wheels, in a conditioned state, have at least one circumferential groove each which, at least in a partial section, tapers off towards the grinding wheel center, to permit the easy conditioning of these grinding wheels at any time and any place without expensive equipment. In such a way, a homogenous sharpness over the groove contour is achieved and both the profiling and the profile-maintaining sharpness influence are achieved in one operating cycle without disassembly of the grinding wheel.

This task is achieved by a conditioning device for grinding wheels for machining the edge areas of plate-shaped objects, such as, for example, glass panes or the like, for which the grinding wheels, in a conditioned state, have at least one circumferential groove each which, at least in a partial section, tapers off towards the grinding wheel center, and for the conditioning of which the conditioning device has a cross section which is adapted to the cross section of the groove to be achieved and in that the width of the conditioning device basically corresponds to the width of the groove(s) and in that the length orientation from one lateral end to the other lateral end of the conditioning device can be configured in accordance with the depth orientation from one side edge to the other side edge of the groove(s) with growing length at an increasing depth to be achieved. This means that the rotating grinding wheel can be conditioned by contact with the bar-shaped conditioning device, while the grinding wheel can remain in the clamping fixture of the grinding equipment. In addition, the width of the conditioning device can be smaller than the groove, through which, however, only partial sections of the groove will be conditioned. On the other hand, the width of the conditioning device can also be larger than the width of the groove, through which the projecting sections will be removed unused.

Sharpening and, if required, profiling of the grinding wheel is effected automatically, at longest possible profile-maintenance, by the specially configured cross section of the conditioning device as the material removal depends on the length engaged in the grinding operation and the length orientation of the conditioning device corresponds to the depth orientation of the groove. Consequently, with the extreme, tapered side edges of the conditioning device, thus having a length of approximately zero, practically no material is removed while with the central areas of the conditioning device, having a longer length, a stronger removal is achieved resulting in the corresponding groove depth at this point.

Also, the width of the conditioning device can basically correspond to the width of the groove(s) and the volume orientation over the width of the conditioning device can be configured in accordance with the depth orientation from one side edge to the other side edge of the groove(s) with growing volume at increasing depth to be achieved, so that by variation of the number and size of incorporated pores or, especially of the clearances configured as lateral grooves or the like, a more or less strong conditioning is achieved.

In addition, the width of the conditioning device can basically correspond to the width of the groove(s) and the abrasive properties of the material of the conditioning device over the width of the conditioning device can be configured in accordance with the depth orientation from one side edge to the other side edge of the groove(s) with better abrasive properties at increasing depth to be achieved.

Furthermore, according to the invention, also the width of the conditioning device can basically correspond to the width of the groove(s) and the adjustment of the grain size distribution in relation to the chip clearances of the grinding wheel over the width of the conditioning device can be configured in accordance with the depth orientation from one side edge to the other side edge of the groove(s) with a better adaptation at increasing depth to be achieved, so that a stronger removal or better sharpening influence of the deeper groove is achieved.

The conditioning device can, in particular, have a bar-shaped form and during the operation it can be subjected to a translatory feed in the direction of its longitudinal axis according to the wear. But also other forms, such as, for example, a semicircular disc-shaped configuration or the like are possible, in that the cross section is configured as described above and that it is constant in direction of the feed.

Preferably, the cross section of the conditioning device or the section of the conditioning device engaged in the conditioning, respectively, can have a more or less triangular shape so that the desired groove form can be achieved with an easily generated geometrical form.

In addition, the cross section of the conditioning device or the section of the conditioning device engaged in the conditioning, respectively, can have a more or less rhomboidal shape so that with equal length orientation a less tapered cross section is achieved which, in axially symmetrical confirguration, can be used for conditioning irrespective of the machining equipment applied.

According to the invention the conditioning device can be composed of a multitude of part components encompassed by a fixing attachment so that based on the layout of the part components it is possible to adjust the contour of the conditioning device in or outside the action zone so that the contour of the groove to be achieved can be selected. This permits the machining and conditioning of multiple groove forms and widths with a single conditioning device.

The part components can be composed of materials with different material properties so that a further influence of the grinding wheel groove to be achieved by the conditioning device can be obtained by variation of the material of the part components.

It can be advantageous to use a conditioning device made of a mineral material with a hardness and abrasive effect suitable for the conditioning of the grinding wheel.

Furthermore, the invention relates to a method for the conditioning of grinding wheels for machining the edge areas of plate-shaped objects, such as, for example, glass panes or the like, for which the grinding wheels, in a conditioned state, have at least one circumferential groove each which, at least in a partial section, tapers off towards the grinding wheel center.

The aforementioned disadvantages are avoided by a method for the conditioning of grinding wheels for machining the edge areas of plate-shaped objects, such as, for example, glass panes or the like, for which the grinding wheels, in a conditioned state, have at least one circumferential groove each which, at least in a partial section, tapers off towards the grinding wheel center, by means of a conditioning device of the before described type, wherein the conditioning device is brought into engagement with the rotating grinding wheel and advanced according to the material removal.

The advancement can be carried out manually or by machine, especially automatically by spring force or controlled by motor-operated drive.

BRIEF DESCRIPTION OF THE DRAWINGS

In the following the examples of execution of the invention shown in the drawing are explained. The individual figures show:

Figure 1:
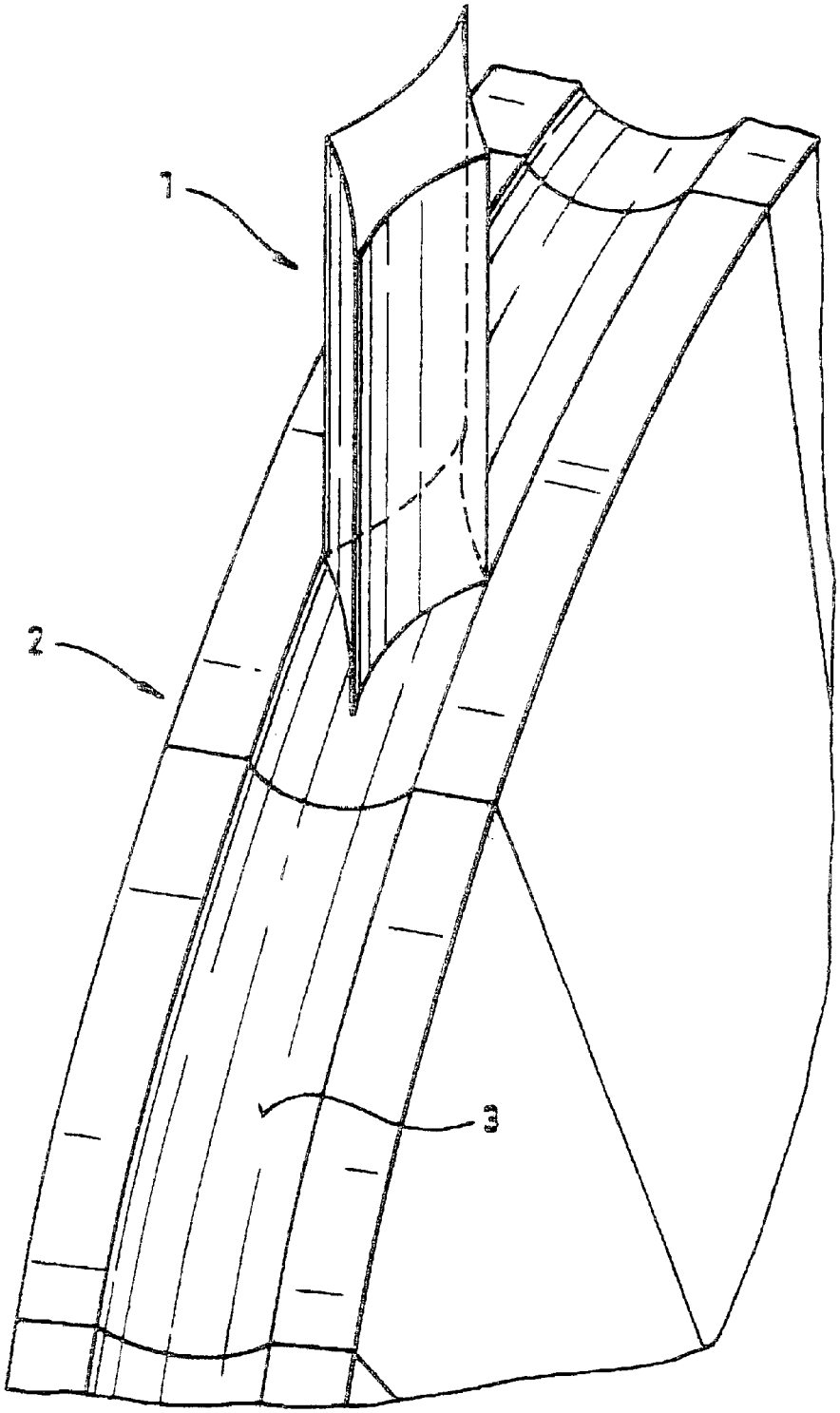
Figure 7:
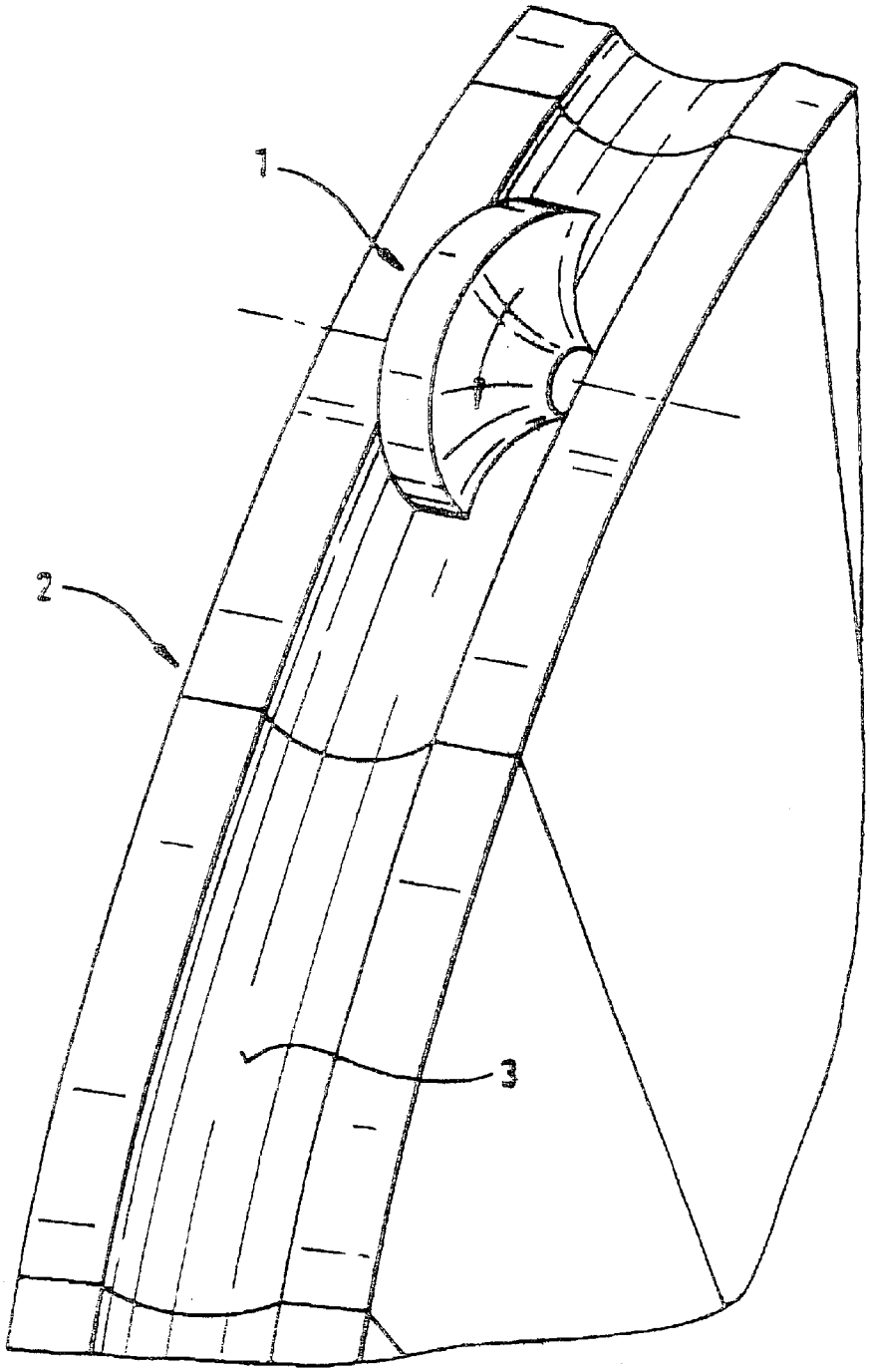

| | |
|---|---|
| FIG. 1 | A perspective view of the conditioning device according to the invention in engagement with a grinding wheel, |
| FIGS. 2–4 | cross sections of further examples of execution of conditioning devices according to the invention, |
| FIG. 5 | the cross section of a conditioning device consisting of several part components, |
| FIG. 6 | the object in a perspective view according to FIG. 5 and |
| FIG. 7 | a perspective view of further conditioning devices according to the invention in engagement with a grinding wheel. |

In all figures identical reference marks are used for equal component units or component units of the same kind, respectively.

DETAILED DESCRIPTION

FIG. 1. shows a bar-shaped conditioning device 1 engaged with a grinding wheel 2 to be conditioned. The grinding wheel 2 has a circumferential groove 3 which tapers off towards the grinding wheel center and which has preferably a more or less semicircular cross section. The grinding wheel 2 can be composed either fully of an abrasive material suitable for the machining of the material or the grinding wheel 2 can be manufactured from another material, such as, for example, metal or the like, and comprise a circumferential ring incorporated into a circumferential recess, made of a corresponding, especially mineral abrasive material.

During the operation of the grinding wheel 2, for example, for grinding the edge areas of plate-shape objects, such as, for example, glass panes or the like, the profiled groove 3 wears out and gradually resembles the contour of the object to be machined. The result is that, depending on the degree of wear of the groove 3, a correct machining of the edge areas to be ground is not possible. In addition, the bluntness can lead to increased machining forces, which in turn can cause damage to the workpieces and can cause profile errors.

To restore the profile of the groove 3, to generate another groove profile into the grinding wheel 2, or to alter the sharpness of the groove 3, the bar-shaped conditioning device 1 is brought into engagement with the groove 3, while the grinding wheel is rotating. With the very short length of the outer sections nearly no material at all is removed, while with increasing length of the cross section of the conditioning device 1 a greater material removal is achieved. Thus, the greatest material removal is achieved in the center of the groove 3 by the center of the conditioning device 1 and, as shown in the example, a more or less semicircular groove 3 is achieved. During the machining process, the bottom edge of the bar-shaped conditioning device 1 naturally takes on a profile according to the cross section of the groove.

The same applies analogously to the sharpening influence in that the outer sections, too, have a substantially lower conditioning effect than the central sections.

With a corresponding configuration of the length orientation of the conditioning device 1 it is possible to achieve any forms of grooves 3 without undercut.

FIG. 2 shows the cross section of a further bar-shaped conditioning device 1 according to the invention, in which a symmectrical formation with straight flanks is provided in both longitudinal and cross direction.

FIG. 3 shows a further example of execution, in which the cross section is only symmetrical in regard to the longitudinal axis, exactly like the cross section according for FIG. 4. The conditioning device 1 can be used with the tapered end pointing to the front but also in reverse direction.

FIG. 5 shows a further example of execution of the invention, in which the conditioning device 1 is composed of a multitude of part components 4 which are encompassed, at least partially, by a fixing attachment 5.

FIG. 6 shows the object according to FIG. 5 in a perspective view. To influence the groove geometry to be achieved, all or only certain part components 4 can be projected from the fixing attachment 5 and thus engage in the conditioning process. Both, the overall cross section of the conditioning device 1, composed of the part components 4, and the part components 4 can have the most various forms.

FIG. 7 shows a further example of execution of a conditioning device 1 according to the invention in engagement with a grinding wheel 2 to be conditioned. The conditioning device 1 has a semicircular disc-shaped configuration as a result of a 180° rotation of a more or less trapezoidal cross section on its wider edge. In case of wear, the conditioning device 1 is advanced in direction of the arrow.

What is claimed is:

1. A conditioning device (1) for grinding wheels (2) for use in machining edge areas of plate-shaped objects wherein said grinding wheels (2) containing a super-abrasive material, in a conditioned state, have at least one circumferential groove (3) each, which, at least in a partial section, tapers off towards a grinding wheel center, and wherein said conditioning device (1) has a cross section which is adapted to a cross section of a groove to be achieved and wherein said width of said conditioning device (1) basically corresponds to said width of the groove(s) (3) and a length orientation from a first lateral end to a second lateral end of the conditioning device (1) is configured in accordance with a depth orientation from a first side edge to a second side edge of said groove(s) (3), with growing length at increasing depth to be achieved, thereby both trueing and dressing said wheel.

2. The conditioning device (1) according to claim 1, characterized by the fact that the width of the conditioning device (1) basically corresponds to the width of the groove (s) (3) and that the volume orientation over the width of the conditioning device is configured in accordance with the depth orientation from one side edge to the other side edge of the groove(s) (3) with growing volume at increasing depth to be achieved.

3. The conditioning device (1) according to claim 1 wherein said width of said conditioning device (1) corresponds to said width of said groove(s) (3) and that abrasive properties of material of said conditioning device (1) over the width of said conditioning device (1) is configured in accordance with said depth orientation from said first side edge to said second side edge of said groove(s) (3) with better abrasive properties at increasing depth to be achieved.

4. The conditioning device (1) according to claim 1 wherein said width of said conditioning device basically corresponds to said width of said groove(s) (3) and an adaptation of a grain size distribution in relation to a chip clearances of said grinding wheel (2) over said width of said conditioning device (1) is configured in accordance with the depth orientation from said first side edge to said second side edge of said groove(s) (3) with better adaptation at increasing depth to be achieved.

5. The conditioning device (1) according to claim 1 wherein said conditioning device (1) has bar-shaped form.

6. The conditioning device (1) according to claim 1 wherein said cross section of said conditioning device (1) has a triangular form.

7. The conditioning device (1) according to claim 1 wherein said cross section of said conditioning device (1) has a rhomboidal form.

8. The conditinioning device (1) according to claim 1 wherein said conditioning device (1) inclues at least one part component (4) encompassed by a fixing attachment (5).

9. The conditioning device (1) according to claim 8, wherein said wherein said part components (4) include materials with different material properties.

10. The conditioning device (1) according the claim 1 wherein said conditioning device (1) mineral material with a hardness and an abrasive effect suitable for the conditioning of the grinding wheel (2).

11. A method for conditioning grinding wheels (2) for machining the edge areas of plate-shaped objects for which the grinding wheels (2), in a conditioned state, have at least one circumferential groove (3) each, which, at least in a partial section, tapers off towards the grinding wheel center, by means of a conditioning device (1) according to claim 1, said method comprising the steps of engaging the conditioning device with the rotating grinding wheel (2) and advancing in accordance with the material removed.

12. The method according to claim 11, including manually advancing the object to be treated.

13. The method according to claim 12, including automatically advancing the object to be treated by spring force or controlled by motor-operated drive.

* * * * *